US010497489B2

(12) United States Patent
Iwasaki et al.

(10) Patent No.: US 10,497,489 B2
(45) Date of Patent: Dec. 3, 2019

(54) CABLE

(71) Applicant: Hitachi Metals, Ltd., Tokyo (JP)

(72) Inventors: Makoto Iwasaki, Hitachi (JP); Motoharu Kajiyama, Takahagi (JP); Yoshiaki Nakamura, Hitachi (JP); Hiroshi Okikawa, Hitachi (JP); Mitsuru Hashimoto, Hitachi (JP); Kenichiro Fujimoto, Hitachi (JP); Akinari Nakayama, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 204 days.

(21) Appl. No.: 14/871,773

(22) Filed: Sep. 30, 2015

(65) Prior Publication Data

US 2016/0125973 A1 May 5, 2016

(51) Int. Cl.
*H01B 3/44* (2006.01)

(52) U.S. Cl.
CPC ..... *H01B 3/441* (2013.01); *H01B 3/448* (2013.01)

(58) Field of Classification Search
CPC ..... H01B 3/441; H01B 3/448
See application file for complete search history.

(56) References Cited

U.S. PATENT DOCUMENTS

2005/0137306 A1* 6/2005 Hausmann ..... C08K 3/0008 524/416
2008/0311328 A1* 12/2008 Kimura ..... C08K 9/06 428/36.91

(Continued)

FOREIGN PATENT DOCUMENTS

CN 103839622 A 6/2014
JP 2001206993 A * 7/2001

(Continued)

OTHER PUBLICATIONS

DuPont.*

(Continued)

*Primary Examiner* — Holly C Rickman
*Assistant Examiner* — Linda N Chau
(74) *Attorney, Agent, or Firm* — McGinn I.P. Law Group, PLLC.

(57) ABSTRACT

A cable includes a conductor, an insulation coating layer on the conductor, and an outer coating layer on the insulation coating layer. The insulation coating layer is made of a composition containing 100 parts by mass of a base polymer (A) and 100 to 250 parts by mass of a non-halogen flame retardant. The polymer (A) contains 70% to 99% by mass of an ethylene-vinyl acetate copolymer (a1) containing an ethylene-vinyl acetate copolymer having a melting point of 70° C. or higher, and 1% to 30% by mass of an acid-modified polyolefin resin (a2) having a glass transition point of −55° C. or lower. The polymer (A) contains 25% to 50% by mass of a vinyl acetate component derived from the copolymer (a1). The outer coating layer is made of a composition containing 100 parts by mass of a base polymer (B) and 150 to 220 parts by mass of a non-halogen flame retardant. The polymer (B) contains 60% to 70% by mass of a linear low-density polyethylene (b1), 10% by mass or more of an ethylene-vinyl acetate copolymer (b2) having a melt flow rate of 100 g/10 min or more, and 10% to 20% by mass of a maleic acid-modified polyolefin (b3).

15 Claims, 1 Drawing Sheet

(56) References Cited

U.S. PATENT DOCUMENTS

| | | | | |
|---|---|---|---|---|
| 2009/0301751 | A1* | 12/2009 | Iwasaki | C08F 8/00 174/110 SR |
| 2013/0312998 | A1* | 11/2013 | Mayama | H01B 7/295 174/110 SR |
| 2014/0030520 | A1* | 1/2014 | Nakamura | H01B 3/308 428/368 |
| 2014/0141240 | A1 | 5/2014 | Segawa et al. | |
| 2014/0141245 | A1 | 5/2014 | Iwasaki et al. | |
| 2015/0030853 | A1* | 1/2015 | Iwasaki | H01B 3/448 428/389 |

FOREIGN PATENT DOCUMENTS

| | | | |
|---|---|---|---|
| JP | 2009-019190 | A | 1/2009 |
| JP | 2014-053247 | A | 3/2014 |
| JP | 2014-101455 | A | 6/2014 |

OTHER PUBLICATIONS

Martienssen et al. (3.3. Polymers).*
English Machine Translation: Oda et al. (JP 2001-206993).*
English Machine Translation: Kimura (JP 2009-019190) and Segawa (JP 2014-101455).*
Chinese Office Action dated Sep. 4, 2017 in Chinese Application No. 201510303472.9 with an English translation thereof.
Japanese Office Action dated Dec. 15, 2017 in Japanese Application No. 2014-222110 with an English translation thereof.
Chinese Office Action dated Mar. 28, 2018 in corresponding Chinese Application No. 201510303472.9 with an English translation thereof.
The Decision of Rejection, dated Nov. 20, 2018, in Chinese Application No. 201510303472.9 and English Translation thereof.
Chinese Office Action, dated May 5, 2019, in Chinese Application No. 201510303472.9 and English Translation thereof.

* cited by examiner

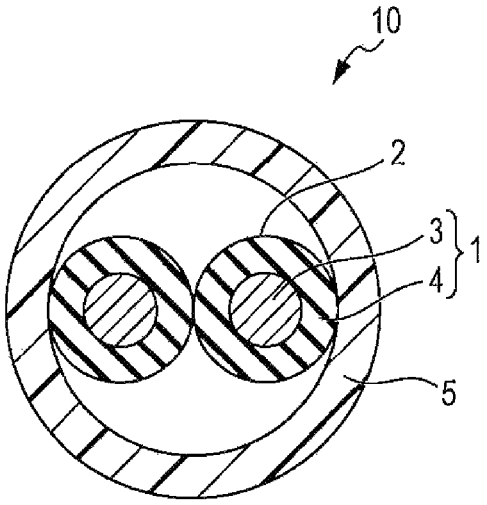
10
2
3
4
1
5

CABLE

The present application is based on Japanese patent application No. 2014-222110 filed on Oct. 30, 2014, the entire contents of which are incorporated herein by reference.

BACKGROUND OF THE INVENTION

1. Field of the Invention

The present invention relates to a cable.

2. Description of the Related Art

A cable includes a conductor, an insulation coating layer on an outer periphery of the conductor, and an outer coating layer (sheath layer) on an outer periphery of the insulation coating layer. An insulation coating layer and a sheath layer are, for example, made of a non-halogen flame-retardant resin composition obtained by adding a non-halogen flame retardant (for example, a metal hydroxide such as aluminum hydroxide) to a halogen-free base polymer. A non-halogen flame-retardant resin composition has excellent flame retardancy and does not generate toxic gas such as hydrogen chloride upon burning.

Japanese Unexamined Patent Application Publication No. 2014-53247, for example, discloses a non-halogen flame-retardant resin composition that contains a base polymer prepared by mixing an ethylene-vinyl acetate copolymer (EVA) and an acid-modified polyolefin.

SUMMARY OF THE INVENTION

Cables used in wiring of railroad vehicles, automobiles, etc., are required to exhibit various properties from the viewpoints of safety and durability. Specifically, higher flame retardancy, fuel resistance, and scratch resistance are required for cables.

While cables are expected to achieve these properties, it is desirable that insulation coating layers of the cables be easy to manufacture in order to improve productivity.

Thus, it is desirable to provide a technology for producing cables having high flame retardancy, fuel resistance, and scratch resistance at high productivity.

In view of the foregoing and other exemplary problems, drawbacks, and disadvantages of the conventional structures, an exemplary feature of the present invention is to provide cable.

According to one exemplary aspect of the invention, a cable that includes a conductor, an insulation coating layer disposed on an outer periphery of the conductor, and an outer coating layer disposed on an outer periphery of the insulation coating layer. The insulation coating layer is made of a non-halogen flame-retardant resin composition that contains 100 parts by mass of a base polymer (A) and 100 parts by mass or more and 250 parts by mass or less of a non-halogen flame retardant, the base polymer (A) containing 70% by mass or more and 99% by mass or less of an ethylene-vinyl acetate copolymer (a1) that contains an ethylene-vinyl acetate copolymer having a melting point of 70° C. or higher, and 1% by mass or more and 30% by mass or less of an acid-modified polyolefin resin (a2) having a glass transition point of −55° C. or lower; and the base polymer (A) contains 25% by mass or more and 50% by mass or less of a vinyl acetate component derived from the ethylene-vinyl acetate copolymer (a1). The outer coating layer is made of a non-halogen flame-retardant resin composition that contains 100 parts by mass of a base polymer (B) and 150 parts by mass or more and 220 parts by mass or less of a non-halogen flame retardant, the base polymer (B) containing 60% by mass or more and 70% by mass or less of a linear low-density polyethylene (b1), 10% by mass or more of an ethylene-vinyl acetate copolymer (b2) having a melt flow rate of 100 g/10 min or more, and 10% by mass or more and 20% by mass or less of a maleic acid-modified polyolefin (b3).

The present invention provides a cable that has good flame retardancy, fuel resistance, and scratch resistance.

BRIEF DESCRIPTION OF THE DRAWING

The foregoing and other exemplary purposes, aspects and advantages will be better understood from the following detailed description of the invention with reference to the drawings, in which:

FIGURE is a cross-sectional view of a cable according to one embodiment of the present invention.

DESCRIPTION OF THE PREFERRED EMBODIMENTS

A non-halogen flame-retardant resin composition used to form an insulation coating layer (hereinafter, this composition is simply referred to as a "flame-retardant resin composition") exemplarily contains a base polymer having a high polarity and containing an ethylene-vinyl acetate copolymer (EVA) and an acid-modified polyolefin resin from the viewpoint of obtaining high flame retardancy and high fuel resistance. An EVA contains a vinyl acetate (VA) component having a polar group and is thus polar. The polar EVA not only is highly resistant to fuels which are non-polar and thus offers high fuel resistance, but also has high flame retardancy. The polarity of EVA increases with the increasing vinyl acetate component content (hereinafter this content is also referred to as a "VA content") and thus an EVA with a high VA content may be used to further improve flame retardancy and fuel resistance of the insulation coating layer.

However, if the polarity of the base polymer is excessively high, the flame-retardant resin composition may undergo blocking. For example, in the case where a flame-retardant resin composition is processed into pellets, the pellets stick to one another to form lumps, resulting in blocking. Once blocking of pellets occurs, it becomes difficult to form an insulation coating layer by extruding the flame-retardant resin composition and thus cables cannot be produced at high productivity.

The inventors of the present invention have conducted studies on this issue and found that when a VA content in the base polymer containing EVA exceeds 50% by mass, the polarity becomes excessively high and blocking easily occurs although the flame-retardant resin composition achieves flame retardancy and fuel resistance. One approach to suppressing blocking is to adjust the VA content in the base polymer to 50% by mass or less. However, at a VA content of 50% by mass or less, the polarity is decreased and the fuel resistance of the insulation coating layer is degraded in particular.

The inventors have conducted further studies to compensate for the decrease in fuel resistance caused by decreasing the VA content in the base polymer to 50% by mass or less. As a result, they have found that use of an EVA having a melting point of 70° C. or higher is favorable. An EVA having a melting point of 70° C. or higher has high crystallinity and thus fuels and the like do not easily penetrate gaps between molecules, thereby offering high fuel resistance. Accordingly, adding a particular EVA to a base polymer can improve fuel resistance of a flame-retardant resin composition. Moreover, an EVA having a melting point of 70° C. or higher does not readily stick and thus blocking of the flame-retardant resin composition can be suppressed by adding this EVA into a base polymer. Accordingly, insulation coating layers having high flame retardancy and fuel resistance can be produced at high productivity by using a flame-retardant resin composition containing a particular EVA.

The present invention has been made on the basis of the above-described findings.

Embodiment

A cable according to an embodiment of the present invention will now be described. Referring now to the drawings, and more particularly to FIG. 1, there is shown exemplary embodiments of the structure according to the present invention. FIGURE is a cross-sectional view of a cable according to an embodiment of the present invention.

1. Structure of Cable

Referring to FIGURE, a cable 10 includes a stranded wire 2 obtained by twisting two insulated electric wires 1. The number of insulated electric wires constituting the stranded wire 2 is not limited to 2 and may be 3 or more. Alternatively, the cable 10 may include one insulated electric wire 1.

Each insulated electric wire 1 constituting the stranded wire 2 includes a conductor 3 and an insulation coating layer 4 on the outer periphery of the conductor 3.

Examples of the conductor 3 that can be used include common metal wires, e.g., a copper wire, a copper alloy wire, an aluminum wire, a gold wire, and a silver wire. A metal wire with a metal plating, such as tin or nickel plating, formed on the outer periphery thereof can also be used. A bunch stranded conductor obtained by twisting metal wires can also be used.

The insulation coating layer 4 is disposed on the outer periphery of the conductor 3. The insulation coating layer 4 is, for example, formed by extruding a particular non-halogen flame-retardant resin composition I to a particular thickness onto the outer periphery of the conductor 3 so as to coat the conductor 3. The insulation coating layer 4 may be crosslinked in order to improve mechanical properties and heat resistance. Detailed accounts of the non-halogen flame-retardant resin composition I forming the insulation coating layer 4 are described below.

An outer coating layer 5 (also referred to as a "sheath layer 5" hereinafter) is disposed on the outer periphery of the stranded wire 2 to coat and protect the stranded wire 2. For example, the sheath layer 5 is formed by extruding a particular non-halogen flame-retardant resin composition II onto a resin tape layer (not shown in the drawing) disposed on the outer periphery of the stranded wire 2. The sheath layer 5 may also be crosslinked as with the insulation coating layer 4. Detailed accounts of the non-halogen flame-retardant resin composition II used for forming the sheath layer 5 are described below.

2. Non-Halogen Flame-Retardant Resin Composition that Forms an Insulation Coating Layer The non-halogen flame-retardant resin composition I that forms the insulation coating layer 4 (hereinafter this composition is simply referred to as a "flame-retardant resin composition I") contains a base polymer (A) and a non-halogen flame retardant.

Base Polymer (A)

The base polymer (A) contains an ethylene-vinyl acetate copolymer (a1) (hereinafter also referred to as an "EVA (a1)") and an acid-modified polyolefin resin (a2).

The EVA (a1) contains at least one EVA having a melting point (Tm) of 70° C. or higher. An EVA having a melting point of 70° C. or higher has high crystallinity and thus suppresses blocking of the flame-retardant resin composition I, thereby improving blocking resistance of the composition. The EVA also improves fuel resistance of the insulation coating layer 4. The general tendency of EVAs is that crystallinity of EVAs decreases and the VA content in the EVAs increases as the melting point decreases. If the melting point of an EVA is less than 70° C., the VA content is high and the crystallinity of the EVA is low; thus, the flame-retardant resin composition I easily undergoes blocking and fuel resistance of the insulation coating layer 4 is degraded. The upper limit of the melting point of the EVA is not particularly limited. From the viewpoint of ease of adjusting the VA content in the base polymer (A) to be within the range of 25% by mass or more and 50% by mass or less, the melting point is preferably 100° C. or lower, more preferably 95° C. or lower, and most preferably 90° C. or lower. An EVA having a melting point in the range of 70° C. or higher and 100° C. or lower has a VA content of, for example, 6% by mass or more and 28% by mass or less. The melting point here is measured by differential scanning calorimetry (DSC).

The EVA (a1) may contain an EVA having a melting point lower than 70° C. in addition to the above-described EVA having a melting point of 70° C. or higher. Compared to the EVA having a melting point of 70° C. or higher, the EVA having a melting point lower than 70° C. has low crystallinity and a relatively high VA content. An EVA having a melting point lower than 70° C. has, for example, a VA content of 28% by mass or more. Using an EVA having a melting point lower than 70° C. in combination with an EVA having a melting point of 70° C. or higher renders it easy to adjust the VA content in the base polymer (A) to be in the range of 25% by mass or more and 50% by mass or more as described in detail below.

The EVA (a1) exemplarily contains at least one EVA having a melt mass-flow rate (MFR) of 6 g/10 min or more. More exemplarily, the EVA having a melting point of 70° C. or higher has an MFR of 6 g/10 min or more. The liquidity (melt flow property) of the flame-retardant resin composition I in a molten state can be increased by using an EVA having an MFR of 6 g/10 min or more and thus the productivity of producing the insulation coating layer 4 by extruding the flame-retardant resin composition I can be improved.

The acid-modified polyolefin resin (a2) is, for example, a polyolefin modified by an unsaturated carboxylic acid or a derivative thereof. The acid-modified polyolefin resin (a2) increases the adhesion between the base polymer (A) and the non-halogen flame retardant and imparts fuel resistance and cold resistance to the non-halogen flame-retardant resin composition I.

Examples of the polyolefin material of the acid-modified polyolefin resin (a2) include ultra-low-density polyethylene, ethylene-methyl acrylate copolymers, ethylene-ethyl acrylate copolymers, ethylene-butene-1 copolymers, ethylene-hexene-1 copolymers, and ethylene-octene-1 copolymers. Examples of the acid that modifies the polyolefin include maleic acid, maleic anhydride, and fumaric acid. The acid-modified polyolefin resin (a2) may be one acid-modified polyolefin resin or a combination of two or more acid-modified polyolefin resins.

The acid-modified polyolefin resin (a2) has a glass transition point (Tg) of −55° C. or lower. Use of the acid-modified polyolefin resin (a2) having a Tg of −55° C. or lower decreases the Tg of the base polymer (A) and suppresses cracking of the insulation coating layer 4 exposed to a low-temperature environment. In other words, the cold resistance of the insulation coating layer 4 can be improved.

VA Content in Base Polymer (A)

The base polymer (A) contains the EVA (a1) and a vinyl acetate (VA) component derived from the EVA (a1). The content of the vinyl acetate component in the base polymer (A) (VA content) is calculated from the following equation if the EVA (a1) contains 1, 2, 3, . . . k, . . . or n EVAs:

$$\text{VA content in base polymer}=\Sigma_{k=1}^{n}X_kY_k \quad (1)$$

In equation (1), $X_k$ represents a VA content (% by mass) in a particular type k of EVA, $Y_k$ represents the proportion of the particular type k of EVA with respect to the entire base polymer, and k represents a natural number.

Specifically, in Example 1 described below, the VA content in the base polymer (A) is calculated as follows: In Example 1, the base polymer (A) contains 20% of an EVA having a VA content of 14% by mass, 50% by of an EVA having a VA content of 46% by mass, and 30% of an acid-modified polyolefin, for a total of 100%. Based on equation (1), the VA content in the base polymer (A) in Example 1 is 25.8% by mass (14×0.2+46×0.5).

The VA content in the base polymer (A) is 25% by mass or more and 50% by mass or less. When the VA content in the base polymer (A) is less than 25% by mass, the polarity of the base polymer (A) is excessively decreased and the insulation coating layer 4 no longer exhibits high flame retardancy. At a VA content exceeding 50% by mass, however, the polarity of the base polymer (A) is excessively increased and blocking of the flame-retardant resin composition I can no longer be suppressed.

The VA content in the base polymer (A) can be changed as desired by controlling the ratio (mass ratio) of the EVA (a1) containing VA to the acid-modified polyolefin resin (a2). The ratio may be any as long as the VA content in the base polymer (A) is within the range of 25% by mass or more and 50% by mass or less. Preferably, the ratio of the EVA (a1) to the acid-modified polyolefin resin (a2) is 70:30 to 99:1. In other words, with respect to the base polymer (A), the content of the EVA (a1) is 70% by mass or more and 99% by mass or less and the content of the acid-modified polyolefin resin (a2) is 1% by mass or more and 30% by mass or less.

If the content of the EVA (a1) is less than 70% by mass, polarity of the base polymer (A) is decreased and the fuel resistance of the insulation coating layer 4 may be degraded. In contrast, if the content of the EVA (a1) exceeds 99% by mass, polarity of the base polymer (A) is increased, the glass transition point of the base polymer (A) is increased, and thus cold resistance of the insulation coating layer 4 may be degraded.

If the content of the acid-modified polyolefin resin (a2) is less than 1% by mass, the effect to be achieved by the acid-modified polyolefin resin (a2) is no longer obtained and fuel resistance and cold resistance may be degraded. In contrast, if the content of the acid-modified polyolefin resin (a2) exceeds 30% by mass, adhesion between the base polymer (A) and the non-halogen flame retardant is excessively increased and thus mechanical properties of the insulation coating layer 4 may be degraded.

The base polymer (A) may contain a polymer other than the EVA (a1) and the acid-modified polyolefin resin (a2). The content of this other polymer relative to the base polymer (A) is 0% by mass or more and 10% by mass or less and preferably 0% by mass or more and 5% by mass or less.

Non-Halogen Flame Retardant

A metal hydroxide or the like can be used as the non-halogen flame retardant. A metal hydroxide is decomposed and dehydrogenated when the non-halogen flame-retardant resin composition I is heated, and the released water decreases the temperature of the non-halogen flame-retardant resin composition I, suppressing combustion. Examples of the metal hydroxide that can be used include magnesium hydroxide, aluminum hydroxide, calcium hydroxide, and any of the aforementioned metal hydroxides with nickel dissolved therein. These non-halogen flame retardants may be used alone or in combination. In particular, at least one of magnesium hydroxide and aluminum hydroxide is exemplarily used. These hydroxides have a heat absorption of 1500 to 1600 J/g upon decomposition and this value is higher than that of calcium hydroxide (1000 J/g).

The non-halogen flame retardant is exemplarily surface-treated with a silane coupling agent, a titanate-based coupling agent, a fatty acid such as stearic acid, a fatty acid salt such as stearate, a fatty acid metal such as calcium stearate, or the like from the viewpoint of adjusting the mechanical properties (balance between tensile strength and elongation) of the insulation coating layer 4.

The content of the non-halogen flame retardant relative to 100 parts by mass of the base polymer (A) is 100 parts by mass or more and 250 parts by mass or less. If the content is less than 100 parts by mass, the insulation coating layer 4 does not exhibit high flame retardancy. At a content exceeding 250 parts by mass, mechanical properties of the insulation coating layer 4 are degraded and elongation is decreased.

Other Additives

The flame-retardant resin composition I may contain other additives as needed. For example, if the insulation coating layer 4 is to be crosslinked, a crosslinking agent or a crosslinking aid may be contained. Examples of the crosslinking method include an irradiation crosslinking method with which the insulation coating layer 4 is crosslinked by irradiation with an electron beam or a radiation and a chemical crosslinking method with which the insulation coating layer 4 is crosslinked by heating. For the irradiation crosslinking method, a crosslinking aid may be added to the flame-retardant resin composition I. Examples of the crosslinking aid include trimethylol propane triacrylate (TMPT) and triallyl isocyanurate (TAIC, registered trade mark). For the chemical crosslinking method, a crosslinking agent may be added to the flame-retardant resin composition I. Examples of the crosslinking agent include organic peroxides such as 1,3-bis(2-t-butylperoxy isopropyl)benzene dicumyl peroxide (DCP).

The flame-retardant resin composition I may contain a flame retardant aid, an antioxidant, a lubricant, a softener, a plasticizer, an inorganic filler, a compatibilizer, a stabilizer, a carbon black, and a colorant in addition to the crosslinking agent. The flame-retardant resin composition I may contain these additives so long as its properties are not adversary affected.

The flame-retardant resin composition I is obtained by mixing the EVA (a1), the acid-modified polyolefin resin (a2), the non-halogen flame-retardant, and, if needed, other additives and kneading the resulting mixture under heating. The kneading conditions and the order in which components are added are not particularly limited. Kneading may be performed with a mixing roll, a Banbury mixer, or a single- or twin-screw extruder, for example.

3. Non-Halogen Flame-Retardant Resin Composition that Forms a Sheath Layer

The non-halogen flame-retardant resin composition II that forms the sheath layer 5 (hereinafter this composition may be simply referred to as "flame-retardant resin composition II") contains a base polymer (B) and a non-halogen flame retardant.

Base Polymer (B)

The base polymer (B) contains a linear low-density polyethylene (b1) (hereinafter may be simply referred to as "LLDPE (b1)"), an ethylene-vinyl acetate copolymer (b2) having a melt flow rate of 100 g/10 min or more (hereinafter this copolymer may be simply referred to as "EVA (b2)"), and a maleic acid-modified polyolefin (b3).

The LLDPE (b1) is a crystalline polymer and improves scratch resistance, oil resistance, and fuel resistance of the sheath layer 5. Although crystalline polymers, such as polypropylene, high-density polyethylene, and low-density polyethylene (LDPE), other than LLDPE (b1) are available, these other crystalline polymers have the following drawbacks. Polypropylene decomposes under electron beams and is thus difficult to crosslink; therefore, the sheath layer 5 does not exhibit sufficient heat resistance. High-density polyethylene causes degradation of mechanical properties, in particular, tensile properties, when large quantities of non-halogen flame retardants are contained. LDPE has a wide molecular weight distribution and a tendency to exhibit a low crystal melting temperature. Note that the LLDPE (b1) in this embodiment is one defined by JIS K 6899-1:2000. Oil resistance refers to resistance to IRM 902 oil. Fuel resistance refers to resistance to IRM 903 oil.

The content of the LLDPE (b1) is 60% by mass or more and 70% by mass or less relative to the base polymer (B). If the LLDPE (b1) content is less than 60% by mass, oil resistance, fuel resistance, and scratch resistance of the sheath layer 5 are insufficient. At a content exceeding 70% by mass, low-temperature properties and tear properties of the sheath layer 5 are insufficient if more than 150 parts by mass of a non-halogen flame retardant is added.

The EVA (b2) has a melt flow rate (MFR) of 100 g/10 min or more and serves as a wax. In other words, the EVA (b2) improves slip properties between the base polymer (B) and the anon-halogen flame retardant. In this embodiment, a large quantity of a non-halogen flame retardant is added to the flame-retardant resin composition II; hence, there is a risk that the sheath layer 5 would have insufficient tear properties and degraded low-temperature tensile properties (hereinafter may be referred to as "low-temperature properties"). However, since the slip properties of the flame-retardant resin composition II can be improved by the EVA (b2), degradation of the tear properties and low-temperature properties caused by a large quantity of a non-halogen flame retardant can be suppressed. If the MFR is less than 100 g/10 min, the EVA (b2) does not exhibit a waxing effect and thus the tear properties and low-temperature properties of the sheath layer 5 are degraded. It should be noted here that the melt flow rate is a figure obtained according to JIS K 7201 at 190° C. and a 2.16 kg load.

The EVA (b2) also increases the polarity of the base polymer (B) and improves compatibility between the base polymer (B) and, for example, a polar additive, such as an antioxidant. As a result, blooming of the additive in the sheath layer 5 can be suppressed.

The content of the EVA (b2) is 10% by mass or more relative to the base polymer (B). Preferably, the EVA (b2) content is 10% by mass or more and 30% by mass or less. At an EVA (b2) content less than 10% by mass, the effect of the EVA (b2) cannot be obtained.

The maleic acid-modified polyolefin (b3) is a polymer obtained by grafting maleic anhydride to a polyolefin or a copolymer of a polyolefin and maleic anhydride. The maleic acid-modified polyolefin (b3) improves adhesion between the base polymer (B) and the non-halogen flame retardant and improves low-temperature properties of the sheath layer 5.

Examples of the polyolefin material used to form the maleic acid-modified polyolefin (b3) include natural rubber, butyl rubber, ethylene propylene rubber, an ethylene α-olefin copolymer, styrene butadiene rubber, nitrile rubber, acrylic rubber, silicone rubber, urethane rubber, polyethylene, polypropylene, an ethylene-vinyl acetate copolymer, polyvinyl acetate, an ethylene-ethyl acrylate copolymer, an ethylene acrylate copolymer, and polyurethane. Among these, ethylene propylene rubber, an ethylene α-olefin copolymer, and an ethylene-ethyl acrylate copolymer are exemplary.

The content of the maleic acid-modified polyolefin (b3) is 10% by mass or more and 20% by mass or less relative to the base polymer (B). At a content less than 10% by mass, the effect of the maleic acid-modified polyolefin (b3) is not obtained. At a content exceeding 20% by mass, adhesion between the base polymer (B) and the non-halogen flame retardant is excessively increased and thus the initial tensile properties of the sheath layer 5, in particular, elongation at break, are degraded.

The base polymer (B) may contain a polymer other than the LLDPE (b1), the EVA (b2), and the maleic acid-modified polyolefin (b3). An example of such a polymer is an ethylene α-olefin copolymer.

Non-Halogen Flame Retardant

Metal hydroxides described above can be used as the non-halogen flame retardant. The content of the non-halogen flame retardant is 150 parts by mass or more and 220 parts by mass or less relative to 100 parts by mass of the base polymer (B). If the content is less than 150 parts by mass, the sheath layer 5 does not exhibit high flame retardancy. At a content exceeding 220 parts by mass, the initial tensile properties of the sheath layer 5 are degraded.

Other Additives

If needed, additives are exemplarily added to the flame-retardant resin composition II. Examples of the additives include an antioxidant, a silane coupling agent, a flame retardant and a flame retardant aid (for example, hydroxystannate, calcium borate, phosphorus-based flame retardants such as ammonium polyphosphate, red phosphorus, and phosphate esters, silicone-based flame retardants such as polysiloxane, nitrogen-based flame-retardants such as melamine cyanurate and cyanuric acid derivatives, borate compounds such as zinc borate, and molybdenum compounds), a crosslinking agent, a crosslinking aid, a crosslinking accelerator, a lubricant, a surfactant, a softener, a plasticizer, an inorganic filler, a carbon black, a compatibilizer, a stabilizer, a metal chelating agent, a UV absorber, a light stabilizer, and a colorant.

In order to crosslink the flame-retardant resin composition II with an electron beam, the dose of the electron beam is preferably 70 to 90 kGy. At a dose less than 70 kGy, insufficient crosslinking may result. At a dose exceeding 90 kGy, excessive crosslinking may result and the initial tensile properties of the sheath layer 5 may become insufficient.

Crosslinking methods other than the electron beam irradiation may be employed as long as sufficient scratch resistance is ensured.

Advantageous Effects of this Embodiment

This embodiment brings one or a plurality of advantageous effects described below.

(a) According to this embodiment, the insulation coating layer 4 is formed by using a flame-retardant resin composition I that contains a base polymer (A); and the base polymer (A) contains an EVA (a1) containing an EVA having a melting point of 70° C. or higher and an acid-modified polyolefin resin (a2) and has a VA content of 50% by mass or less. The EVA having a melting point of 70° C. or higher has high crystallinity and exhibits high fuel resistance since fuels and the like do not easily penetrate gaps between molecules. Although fuel resistance may be degraded by limiting the VA content in the base polymer (A) to 50% by mass or less, this degradation of fuel resistance can be compensated by using the EVA having a melting point of 70° C. or higher. Accordingly, an insulation coating layer 4 that exhibits high fuel resistance and undergoes less deterioration upon contact with fuels can be formed.

(b) According to this embodiment, the VA content in the base polymer (A) is 25% by mass or more. As a result, the polarity of the base polymer (A) can be increased and the flame retardancy of the insulation coating layer 4 can be improved.

(c) According to this embodiment, the VA content in the base polymer (A) is 50% by mass or less. As a result, the polarity of the base polymer (A) can be decreased and blocking of the flame-retardant resin composition I can be suppressed. Blocking of the flame-retardant resin composition I can be further suppressed when an EVA having high crystallinity and a melting point of 70° C. or higher is used as the EVA (a1). Such a flame-retardant resin composition I is unlikely to undergo blocking even when it is pelletized and offers high handling ease. Thus, the insulation coating layer 4 can be formed at high productivity by using the flame-retardant resin composition I.

(d) According to this embodiment, the content of the non-halogen flame retardant is 100 parts by mass or more and 250 parts by mass or less relative to 100 parts by mass of the base polymer (A). As a result, flame retardancy can be improved without degrading mechanical strength (tensile strength and elongation) of the insulation coating layer 4.

(e) According to this embodiment, the acid-modified polyolefin resin (a2) having a glass transition point of −55° C. or lower is added to the base polymer (A). As a result, the glass transition point of the base polymer (A) can be decreased and cold resistance of the insulation coating layer 4 can be improved.

(f) According to this embodiment, the ratio of the EVA (a1) to the acid-modified polyolefin resin (a2) is 70:30 to 99:1. As a result, fuel resistance and cold resistance can be improved while striking a proper balance without degrading mechanical properties of the insulation coating layer 4.

(g) According to this embodiment, the ethylene-vinyl acetate copolymer having a melting point of 70° C. or higher has a melt flow rate of 6 g/10 min or more. As a result, the liquidity (melt flow property) of the flame-retardant resin composition I in a molten state can be improved and thus the insulation coating layer 4 can be formed at high productivity.

(h) According to this embodiment, the insulation coating layer 4 does not contain any halogen and thus halogen gas is not generated upon burning.

(i) According to this embodiment, the sheath layer 5 is formed by using the flame-retardant resin composition II that contains a base polymer (B) that contains 60% to 70% by mass of the LLDPE (b1). Since the LLDPE (b1) is a crystalline polymer, a sheath layer 5 having good scratch resistance, oil resistance, and fuel resistance can be formed by using the LLDPE (b1).

(j) According to this embodiment, the base polymer (B) contains 10% by mass or more of the EVA (b2) having a MFR of 100 g/10 min or more. Since the EVA (b2) can improve the slip properties between the base polymer (B) and the non-halogen flame retardant, tear properties and low-temperature properties of the sheath layer 5 can be improved.

(k) Since the EVA (b2) increases the polarity of the base polymer (B) and improves the compatibility between the base polymer (B) and polar additives, such as an antioxidant, blooming of additives from the sheath layer 5 can be suppressed.

(l) According to this embodiment, the base polymer (B) contains 10 to 20% by mass of the maleic acid-modified polyolefin (b3). The maleic acid-modified polyolefin (b3) improves adhesion between the base polymer (B) and the non-halogen flame retardant so as to improve low-temperature properties of the sheath layer 5.

(m) According to this embodiment, the sheath layer 5 does not contain any halogen and thus halogen gas is not generated upon burning.

(n) The cable 10 of this embodiment includes the insulation coating layer 4 that has the effects described in (a) to (h) above and the sheath layer 5 that has the effects described in (i) to (m) above. Accordingly, the cable 10 has excellent properties and can be used in, for example, wiring of railroad vehicles.

Other Embodiments of the Present Invention

While the present invention has been specifically described through one embodiment, the scope of the present invention is not limited to the above-described embodiment and various modifications and alterations are possible without departing from the spirit of the invention.

In the embodiment described above, the insulation coating layer 4 has a single-layer structure. Alternatively, the insulation coating layer 4 may have a multilayer structure. In forming a insulation coating layer 4 having a multilayer structure, the non-halogen resin composition described above may be used to form the outermost layer and a polyolefin resin or a rubber material may be used to form layers other than the outermost layer.

Examples of the polyolefin resin include low-density polyethylene, an ethylene-vinyl acetate copolymer, an ethylene-ethyl acrylate copolymer, an ethylene-methyl acrylate copolymer, an ethylene-glycidyl methacrylate copolymer, and a maleic anhydride-modified polyolefin. These polyolefin resins may be used alone or in combination.

Examples of the rubber material include ethylene-propylene copolymer rubber (EPR), ethylene-propylene-diene ternary copolymer rubber (EPDM), acrylonitrile-butadiene rubber (NBR), hydrogenated NBR (HNBR), acrylic rubber, ethylene-acrylate copolymer rubber, ethylene-octene copolymer rubber (EOR), ethylene-vinyl acetate copolymer rubber, ethylene-butene-1 copolymer rubber (EBR), butadiene-styrene copolymer rubber (SBR), isobutylene-isoprene copolymer rubber (IIR), block copolymer rubber that includes a polystyrene block, urethane rubber, and phosphazene rubber. These rubber materials may be used alone or in combination.

In the embodiment described above, the sheath layer 5 has a single layer structure. As with the insulation coating layer 4, the sheath layer 5 can also have a multilayer structure. In forming a sheath layer 5 having a multilayer structure, a non-halogen resin composition having flame retardancy may be used to form the outermost layer and the polyolefin resins described above may be used to form layers other than the outermost layer.

In the cable 10, a separator (not shown) or a braided layer (not shown) may be present between the insulation coating layer 4 and the sheath layer 5.

EXAMPLES

The present invention will now be described in more specific details by using Examples below which do not limit the scope of the invention.

The materials used in preparation of a non-halogen flame retardant resin composition I for forming an insulation coating layer were as follows.

The following materials were used as the EVA (a1):

EVA (Tm: 89° C., MFR=15 g/10 min, VA content: 14% by mass): Evaflex EV550 produced by Du Pont-Mitsui Polychemicals Co., Ltd.

EVA (Tm: 72° C., MFR: 6 g/10 min, VA content: 28% by mass): Evaflex EV260 produced by Du Pont-Mitsui Polychemicals Co., Ltd.

EVA (Tm: 62° C., MFR: 1 g/10 min, VA content: 33% by mass): Evaflex EV170 produced by Du Pont-Mitsui Polychemicals Co., Ltd.

EVA (Tm: lower than 70° C., MFR: 100 g/10 min, VA content: 46% by mass): Evaflex EV45X produced by Du Pont-Mitsui Polychemicals Co., Ltd.

EVA (Tm: lower than 70° C., MFR: 2.5 g/10 min, VA content: 46% by mass): Evaflex EV45LX produced by Du Pont-Mitsui Polychemicals Co., Ltd.

EVA (Tm: lower than 70° C., MFR: 5.1 g/10 min, VA content: 80% by mass): Levapren 800 produced by LANXESS The following materials were used as the acid-modified polyolefin resin (a2):

Acid-modified polyolefin (Tm: 70° C., Tg: −55° C. or lower): TAFMER MA8510 produced by Mitsui Chemicals, Inc.

Acid-modified polyolefin (Tm: 66° C., Tg: −50° C. or lower): OREVAC G 18211 produced by ARKEMA The following materials were used as the non-halogen flame-retardant:

Magnesium hydroxide (silane-treated): MAGNIFIN H10A produced by ALBEMARLE Corporation Magnesium hydroxide (fatty acid-treated): MAGNIFIN H10C produced by ALBEMARLE Corporation Aluminum hydroxide (silane-treated): BF013STV produced by Nippon Light Metal Co., Ltd.

Aluminum hydroxide (fatty acid-treated) HIGILITE H42S produced by SHOWA DENKO K.K.

The following material was used as an additive:

Trimethylol propane triacrylate (crosslinking aid): TMPT produced by Shin-Nakamura Chemical Co., Ltd.

The materials used in preparation of a non-halogen flame-retardant resin composition II for forming a sheath layer are as follows.

The following material was used as the LLDPE (b1):

Linear low-density polyethylene (b1) (LLDPE, MFR: 1.0 g/10 min, density: 0.915): Evolue SP1510 produced by Prime Polymer Co., Ltd.

The following materials were used as the EVA (b2):

EVA (Tm: lower than 70° C., MFR: 100 g/10 min, VA content: 46% by mass): Evaflex EV45X produced by Du Pont-Mitsui Polychemicals Co., Ltd.

EVA (Tm: lower than 70° C., MFR: 2.5 g/10 min, VA content: 46% by mass): Evaflex EV45LX produced by Du Pont-Mitsui Polychemicals Co., Ltd.

The following material was used as the maleic acid-modified polyolefin (b3):

Maleic acid-modified polyolefin: TAFMER MH5040 produced by Mitsui Chemicals, Inc.

High-density polyethylene (HDPE) was used as other polymers.

The following materials were used as the additives:

Magnesium hydroxide: Magseeds S4 produced by Konoshima Chemical Co., Ltd.

FT carbon

Composite-type antioxidant: AO-18 produced by ADEKA Corporation

Phenol-based antioxidant: Irganox 1010 produced by BASF

Zinc stearate

1. Preparation of Pellets for Forming Insulation Coating Layers

First, components were blended as shown in Table 1. The resulting mixture was kneaded with a pressure kneader at a start temperature of 40° C. and an end temperature of 200° C. to obtain a non-halogen flame retardant resin composition I for forming an insulation coating layer. The flame-retardant resin composition I was then pelletized. As a result, pellets for forming insulation coating layers of Examples 1 to 6 and Comparative Examples 1 to 8 were obtained.

TABLE 1

| | | | Examples | | | | | | Comparative Examples | |
|---|---|---|---|---|---|---|---|---|---|---|
| | | | 1 | 2 | 3 | 4 | 5 | 6 | 1 | 2 |
| Base polymer (A) | EVA (a1) | EVA (Tm: 89° C., MFR: 15 g/10 min, VA content: 14 mass % | 20 | 64 | — | 20 | — | 20 | 69 | — |
| | | EVA (Tm: 72° C., MFR: 6 g/10 min, VA content: 28 mass % | — | — | 70 | — | 5 | — | — | — |
| | | EVA (Tm: 62° C., MFR: 1 g/10 min, VA content: 33 mass % | — | — | — | — | — | — | — | — |
| | | EVA (Tm: less than 70° C., MFR: 100 g/10 min, VA content: 46 mass % | 50 | 35 | 15 | 50 | — | 50 | 30 | 10 |
| | | EVA (Tm: less than 70° C., MFR: 2.5 g/10 min, VA content: 46 mass % | — | — | — | — | 94 | — | — | — |

TABLE 1-continued

| | | | | | | | | | |
|---|---|---|---|---|---|---|---|---|---|
| | EVA (Tm: less than 70° C., MFR: 5.1 g/10 min, VA content: 80 mass % | — | — | — | — | — | — | — | 60 |
| Acid-modified polyolefin (a2) | Acid-modified polyolefin (Tm: 70° C., Tg: −55° C. or lower) | 30 | 1 | 15 | 30 | 1 | 30 | 1 | 30 |
| | Acid-modified polyolefin (Tm: 66° C., Tg: −50° C. or lower) | — | — | — | — | — | — | — | — |
| Non-halogen flame retardant | Silane-treated magnesium hydroxide | 80 | 80 | 80 | 50 | 100 | — | 100 | 100 |
| | Fatty acid-treated magnesium hydroxide | 120 | 120 | 120 | 50 | 150 | — | 100 | 100 |
| | Silane-treated aluminum hydroxide | — | — | — | — | — | 100 | — | — |
| | Fatty acid-treated aluminum hydroxide | — | — | — | — | — | 80 | — | — |
| Crosslinking aid | Trimethylol propane triacrylate | 4 | 4 | 4 | 4 | 4 | 4 | 4 | 4 |
| VA content in base polymer (mass %) | | 25.8 | 25.1 | 26.5 | 25.8 | 44.6 | 25.8 | 23.5 | 52.6 |

| | | | Comparative Examples | | | | | |
|---|---|---|---|---|---|---|---|---|
| | | | 3 | 4 | 5 | 6 | 7 | 8 |
| Base polymer (A) | EVA (a1) | EVA (Tm: 89° C., MFR: 15 g/10 min, VA content: 14 mass % | 10 | — | 64 | 64 | 64 | — |
| | | EVA (Tm: 72° C., MFR: 6 g/10 min, VA content: 28 mass % | — | 100 | — | — | — | — |
| | | EVA (Tm: 62° C., MFR: 1 g/10 min, VA content: 33 mass % | — | — | — | — | — | 90 |
| | | EVA (Tm: less than 70° C., MFR: 100 g/10 min, VA content: 46 mass % | — | — | 35 | 35 | 35 | — |
| | | EVA (Tm: less than 70° C., MFR: 2.5 g/10 min, VA content: 46 mass % | — | — | — | — | — | — |
| | | EVA (Tm: less than 70° C., MFR: 5.1 g/10 min, VA content: 80 mass % | 55 | — | — | — | — | |
| | Acid-modified polyolefin (a2) | Acid-modified polyolefin (Tm: 70° C., Tg: −55° C. or lower) | 35 | — | 1 | 1 | — | — |
| | | Acid-modified polyolefin (Tm: 66° C., Tg: −50° C. or lower) | — | — | — | — | 1 | 10 |
| Non-halogen flame retardant | | Silane-treated magnesium hydroxide | 100 | 100 | 40 | 110 | 100 | 100 |
| | | Fatty acid-treated magnesium hydroxide | 100 | 100 | 50 | 150 | 150 | 100 |
| | | Silane-treated aluminum hydroxide | — | — | — | — | — | — |
| | | Fatty acid-treated aluminum hydroxide | — | — | — | — | — | — |
| Crosslinking aid | | Trimethylol propane triacrylate | 4 | 4 | 4 | 4 | 4 | 4 |
| VA content in base polymer (mass %) | | | 45.4 | 28 | 25.1 | 25.1 | 25.1 | 29.7 |

2. Preparation of Pellets for Forming Sheaths

Components were blended as shown in Table 2. The resulting mixture was kneaded with a pressure kneader at a start temperature of 40° C. and an end temperature of 200° C. to obtain a non-halogen flame-retardant resin composition II for forming a sheath. Then the non-halogen flame-retardant resin composition II was pelletized. As a result, pellets for forming sheaths of Examples 1 to 6 and comparative Examples 1 to 8 were obtained.

TABLE 2

| | | | Examples | | | | | | Comparative Examples | |
|---|---|---|---|---|---|---|---|---|---|---|
| | | | 1 | 2 | 3 | 4 | 5 | 6 | 1 | 2 |
| Base polymer (B) | Linear low-density polyethylene (b1) (LLDPE) | | 60 | 70 | 60 | 70 | 70 | 70 | — | 50 |
| | High-density polyethylene (HDPE) | | — | — | — | — | — | — | 60 | — |
| | EVA (b2) | EVA (Tm: less than 70° C., MFR: 100 g/10 min, VA content: 46 mass %) | 30 | 20 | 20 | 10 | 10 | 10 | 30 | 30 |
| | | EVA (Tm: less than 70° C., MFR: 2.5 g/10 min, VA content: 46 mass %) | — | — | — | — | — | — | — | — |
| | Maleic acid-modified polyolefin (b3) | | 10 | 10 | 20 | 20 | 20 | 20 | 10 | 20 |

TABLE 2-continued

| | | | | | | | | | |
|---|---|---|---|---|---|---|---|---|---|
| Flame retardant | Magnesium hydroxide | 200 | 200 | 200 | 180 | 220 | 150 | 200 | 200 |
| Crosslinking aid | Trimethylol propane triacrylate | 2 | 2 | 2 | 2 | 2 | 2 | 2 | 2 |
| Other additives | FT carbon | 2 | 2 | 2 | 10 | 2.5 | 10 | 2 | 2 |
| | Composite-type antioxidant | 1 | 1 | 1 | 1 | 1 | 1 | 1 | 1 |
| | Phenolic antioxidant | 2 | 2 | 2 | 2 | 2 | 2 | 2 | 2 |
| | Zinc stearate | 1 | 1 | 1 | 1 | 1 | 1 | 1 | 1 |

| | | | Comparative Examples | | | | | |
|---|---|---|---|---|---|---|---|---|
| | | | 3 | 4 | 5 | 6 | 7 | 8 |
| | Base polymer (B) | Linear low-density polyethylene (b1) (LLDPE) | 80 | 70 | 60 | 60 | 60 | 60 |
| | | High-density polyethylene (HDPE) | — | — | — | — | — | — |
| | | EVA (b2) EVA (Tm: less than 70° C., MFR: 100 g/10 min, VA content: 46 mass %) | 10 | 5 | 35 | — | 30 | 30 |
| | | EVA (Tm: less than 70° C., MFR: 2.5 g/10 min, VA content: 46 mass %) | — | — | — | 30 | — | — |
| | | Maleic acid-modified polyolefin (b3) | 10 | 25 | 5 | 10 | 10 | 10 |
| | Flame retardant | Magnesium hydroxide | 150 | 200 | 200 | 200 | 140 | 230 |
| | Crosslinking aid | Trimethylol propane triacrylate | 2 | 2 | 2 | 2 | 2 | 2 |
| | Other additives | FT carbon | 2 | 2 | 2 | 2 | 2 | 2 |
| | | Composite-type antioxidant | 1 | 1 | 1 | 1 | 1 | 1 |
| | | Phenolic antioxidant | 2 | 2 | 2 | 2 | 2 | 2 |
| | | Zinc stearate | 1 | 1 | 1 | 1 | 1 | 1 |

3. Preparation of Cable

Next, pellets for an insulation coating layer were charged in a 65 mm extruder, heated at 150° C., and melted. The melt of the non-halogen flame-retardant resin composition I for forming an insulation coating layer was extruded onto the outer periphery of a conductor from the extruder so that the outer diameter was 1.4 mm to thereby form an insulation coating layer. The insulation coating layer was irradiated with an electron beam of 10 Mrad to perform crosslinking. As a result, insulated electric wires of Examples 1 to 6 and Comparative Examples 1 to 8 were obtained. In this embodiment, a stranded conductor formed by stranding nineteen conductors each having a diameter of 0.18 mm was used as the conductor.

Pellets for forming a sheath were charged in a 90 mm extruder, heated at 120° C., and melted. The melt of the non-halogen flame-retardant resin composition II for forming a sheath was extruded from an extruder onto the outer periphery of the outer periphery of a twisted pair, which had been obtained by twisting two of the insulated electric wires described above, so that the outer diameter was 4.4 mm to thereby form a sheath. The sheath was irradiated with an electron beam of 4 Mrad to perform crosslinking. As a result, cables of Examples 1 to 6 and Comparative Examples 1 to 8 were obtained.

4. Evaluation Method

The pellets for forming insulation coating layers, the insulation coating layers, and the sheaths were evaluated by the following methods.

4.1 Evaluation of Pellets for Insulation Coating Layers and Evaluation of Insulation Coating Layers Room-temperature storage property: In order to evaluate blocking resistance of pellets for forming insulation coating layers, the pellets were stored at room temperature and whether blocking occurred was evaluated. Specifically, 20 kg of pellets for forming an insulation coating layer were packed in a 420 mm×820 mm paper bag and two such bags were placed on top of each other in a constant-temperature oven at 40° C. and left to stand for 240 hours. Then the pellets were discharged into a vat and whether blocking of pellets occurred was checked. Those samples which did not undergo blocking were rated "pass (P)" and those which underwent blocking were rated "fail (F)".

Mechanical properties: An insulation coating layer obtained by removing the conductor from an insulated electric wire was subjected to a tensile test according to EN 60811-1-1 and mechanical properties were evaluated. A tensile strength of 10 MPa or more and an elongation of 125% or more were set as a target. Samples that achieved the target were rated "pass (P)" and those that did not achieve the target were rated "fail (F)".

Fuel resistance: An insulation coating layer obtained by removing the conductor from the insulated electric wire was subjected to a fuel resistance test according to EN 60811-1-3 and fuel resistance was evaluated. Specifically, the insulation coating layer was immersed in a fuel resistance testing oil IRM 903, heated in a 70° C. constant-temperature oven for 168 hours, left to stand at room temperature for 16 hours, and subjected to a tensile test after immersion. The tensile strength retention of the tensile strength after oil immersion relative to the initial (before oil immersion) tensile strength and the elongation retention of the elongation after oil immersion relative to the initial elongation were measured for each insulation coating layer. Samples with a tensile strength retention of 70% or more were rated "pass (P)" and samples with a tensile strength retention less than 70% were rated "fail (F)". Samples with an elongation retention of 60% or more were rated "pass (P)" and samples with an elongation retention less than 60% were rated "fail (F)".

Cold resistance: In order to evaluate the cold resistance of the insulation coating layer, the insulated electric wire was subjected to a bend test according to EN 60811-1-4 8.1 at −40° C. Samples in which the insulation coating layer did not crack due to the bend test were rated "pass (P)" and samples in which the insulation coating layer cracked due to the bend test were rated "fail (F)".

Flame retardancy: In order to evaluate the flame retardancy of the insulation coating layer, the insulated electric wire was subjected to a vertical flame test according to EN 60332-1-2. If the distance between the lower end of an upper support and the point at which charring started was 50 mm or more after flame was extinguished from the insulation coating layer, such samples were rated "pass (P)" and if the distance was less than 50 mm, such samples were rated "fail (F)".

4.2 Evaluation of Sheaths

Mechanical properties: A sheath was removed from a cable and subjected to a tensile test by a procedure described in JIS K 6251. Specifically, the sheath was punched with a dumbbell #6 to obtain a test sample and the test sample was subjected to a tensile stress by using a tensile tester at a rate of 200 ram/min. The initial tensile strength and the initial tensile elongation were measured. Samples with an initial tensile strength of 10 MPa or more and an initial tensile elongation of 150% or more were rated "pass (P)" and samples that did not meet these values were rated "fail (F)".

Oil resistance: A sheath removed from a cable was punched with a dumbbell #6 to obtain a test sample. The test sample was immersed in IRM 902 at 100° C. for 72 hours. The test sample after immersion was subjected to tensile stress by using a tensile tester at a rate of 200 ram/min and the tensile strength and elongation at break were measured. Based on the results of the initial (before immersing) tensile test, samples with a tensile strength retention of 70% to 130% and a retention of elongation at break of 60% to 140% were rated "pass (P)" and samples that did not meet these values were rated "fail (F)".

Fuel resistance: A sheath removed from a cable was punched with a dumbbell #6 to prepare a test sample and the test sample was immersed in IRM 903 at 70° C. for 168 hours. The test sample after immersion was subjected to tensile stress at a rate of 200 mm/min by using a tensile tester and the tensile strength and elongation at break were measured. Based on the results of the initial (before immersion) tensile test, those samples with a tensile strength retention of 70% to 130% and a retention of elongation at break of 60% or more and 140% or less were rated "pass (P)" and other samples were rated "fail (F)".

Low-temperature properties: A cable was left to stand in a −40° C. environment for 16 hours. The cable was wound six turns on a mandrel having an outer diameter 10 times that of the cable in the same environment. Samples in which the sheath did not crack were rated "pass (P)" and samples in which the sheath cracked were rated "fail (F)".

Scratch resistance: A cable was subjected to a dynamic cut through test according to EN 50305-5.6 and rated pass or fail.

Tear properties: Pellets for forming sheaths of Examples and Comparative Examples were kneaded with a 6-inch open roll and pressed at 180° C. for 3 minutes to prepare sheets having a thickness of 1 mm. The sheets were irradiated with an electron beam of 70 kGy to perform crosslinking. The resulting sheets were subjected to a tear test described in JIS C 3315-6.12. Samples with a tear strength of 250 N/cm or more and an elongation of 15 mm or more were rated "pass (P)" and other samples were rated "fail (F)".

Flame retardancy: A cable was subjected to a vertical flame test according to EN 60332-1-2 and was rated pass or fail.

Blooming: A cable was wrapped with an aluminum foil and left to stand in a 80° C. atmosphere for 2 weeks. Occurrence of blooms in the sheath was observed visually and samples with no bloom were rated "pass (P)" and samples with blooms were rated "fail (F)".

4.3 Comprehensive Evaluation

Samples that were rated "pass (P)" for both the insulation coating layer and the sheath were rated "pass (P)". Samples that were rated "fail (F)" for one or both of the insulation coating layer and the sheath were rated "fail (F)".

5. Evaluation Results

Results of evaluation are shown in Table 3 below.

TABLE 3

| | | | | Examples | | | | | | Comparative Examples | |
|---|---|---|---|---|---|---|---|---|---|---|---|
| | | | | 1 | 2 | 3 | 4 | 5 | 6 | 1 | 2 |
| Evaluation | Insulation coating layer | Room-temperature storage property | | P | P | P | P | P | P | P | F |
| | | Mechanical properties | Tensile strength (MPa) | 13.4 | 11.4 | 10.7 | 12.1 | 10.2 | 12.5 | 11.8 | 15.6 |
| | | | | P | P | P | P | P | P | P | P |
| | | | Elongation (%) | 127 | 317 | 213 | 303 | 125 | 187 | 320 | 123 |
| | | | | P | P | P | P | P | P | P | P |
| | | Fuel resistance | Tensile strength retention (%) | 89 | 70 | 80 | 83 | 79 | 82 | 89 | 95 |
| | | | | P | P | P | P | P | P | P | P |
| | | | Elongation retention (%) | 95 | 62 | 94 | 92 | 92 | 91 | 95 | 93 |
| | | | | P | P | P | P | P | P | P | P |
| | | Cold resistance | | P | P | P | P | P | P | P | P |
| | | Flame retardancy | | P | P | P | P | P | P | F | P |
| | Outer coating layer (sheath layer) | Mechanical properties | Initial tensile strength (MPa) | 11.2 | 12.3 | 18.3 | 18.2 | 17.5 | 18.5 | 23.3 | 15.5 |
| | | | Initial tensile elongation (%) | 280 | 227 | 170 | 160 | 150 | 180 | 70 | 170 |
| | | Oil resistance | | P | P | P | P | P | P | P | F |
| | | Fuel resistance | | P | P | P | P | P | P | P | F |
| | | Low-temperature properties | | P | P | P | P | P | P | P | P |
| | | Scratch resistance | | P | P | P | P | P | P | P | F |
| | | Tear properties | | P | P | P | P | P | P | P | P |
| | | Flame retardancy | | P | P | P | P | P | P | P | P |
| | | Presence of bloom | | P | P | P | P | P | P | P | P |
| | Comprehensive evaluation | | | P | P | P | P | P | P | F | F |

TABLE 3-continued

| | | | | Comparative Examples | | | | | |
|---|---|---|---|---|---|---|---|---|---|
| | | | | 3 | 4 | 5 | 6 | 7 | 8 |
| Evaluation | Insulation coating layer | Room-temperature storage property | | P | P | P | P | P | F |
| | | Mechanical properties | Tensile strength (MPa) | 16.2 | 12.5 | 12.3 | 9.5 | 10.2 | 13.5 |
| | | | | P | P | P | F | P | P |
| | | | Elongation (%) | 90 | 280 | 290 | 90 | 130 | 230 |
| | | | | F | P | P | F | P | P |
| | | Fuel resistance | Tensile strength retention (%) | 94 | 68 | 79 | 85 | 78 | 69 |
| | | | | P | F | P | P | P | F |
| | | | Elongation retention (%) | 98 | 59 | 92 | 99 | 90 | 50 |
| | | | | P | F | P | P | P | F |
| | | Cold resistance | | P | F | P | P | F | P |
| | | Flame retardancy | | P | P | F | P | P | P |
| | Outer coating layer (sheath layer) | Mechanical properties | Initial tensile strength (MPa) | 18.6 | 19.5 | 13.2 | 15.2 | 16.3 | 12.2 |
| | | | Initial tensile elongation (%) | 120 | 130 | 230 | 180 | 250 | 100 |
| | | Oil resistance | | P | P | P | P | P | P |
| | | Fuel resistance | | P | P | P | P | P | P |
| | | Low-temperature properties | | F | P | F | P | P | P |
| | | Scratch resistance | | P | P | P | P | P | P |
| | | Tear properties | | F | F | P | F | P | P |
| | | Flame retardancy | | P | P | P | P | F | P |
| | | Presence of bloom | | P | F | P | P | P | P |
| | Comprehensive evaluation | | | F | F | F | F | F | F |

As shown in Table 3, pellets for forming insulation coating layers in Examples 1 to 6 had a good room-temperature storage property (blocking resistance) and the insulation coating layers made of these pellets had good properties. It was also confirmed that the sheath layers had good properties. In sum, the comprehensive evaluation of Examples 1 to 6 was "pass (P)".

In Comparative Example 1, as shown in Table 1, the VA content in the base polymer (A) of the insulation coating layer was less than 25% by mass and thus the flame retardancy of the insulation coating layer was low. As shown in Table 2, since HDPE was used in the base polymer (B) of the sheath layer instead of the LLDPE (b1), the initial tensile elongation of the sheath layer was smaller than 150%.

In Comparative Example 2, the pellets for forming an insulation coating layer did not contain an EVA having a melting point of 70° C. or higher and the VA content in the base polymer (A) was greater than 50% by mass. Thus, the room-temperature storage property (blocking resistance) was low and occurrence of blocking was confirmed. Since the content of the LLDPE (b1) in the sheath layer was 50% by mass, which was less than 60% by mass, oil resistance, fuel resistance, and scratch resistance were insufficient.

In Comparative Example 3, the mass ratio of the acid-modified polyolefin resin (a2) in the insulation coating layer was 35, which was greater than 30. Thus the insulation coating layer had a small elongation and degraded mechanical properties. Since the content of the LLDPE (b1) in the sheath layer was excessively high, namely, 80% by mass, the elongation of the sheath layer was insufficient.

In Comparative Example 4, the insulation coating layer did not contain an acid-modified polyolefin resin (a2) and thus the fuel resistance of the insulation coating layer was low. In the cold resistance test, the insulation coating layer cracked and the cold resistance of the insulation coating layer was low. Since the sheath layer had a low EVA (b2) content, the initial elongation and the tear properties were small and occurrence of blooms was confirmed.

In Comparative Example 5, the content of the non-halogen flame retardant in the insulation coating layer was decreased to 90 parts by mass and thus the flame retardancy of the insulation coating layer was low. Since the content of the maleic acid-modified polyolefin (b3) in the sheath layer was low, the low-temperature properties were insufficient and occurrence of cracking (cracks) was confirmed.

In Comparative Example 6, the content of the non-halogen flame retardant in the insulation coating layer was increased to 260 parts by mass and thus the elongation was small although flame retardancy of the insulation coating layer was high. Since an EVA having an MFR less than 100 g/10 min was used as the EVA (b2) in the sheath layer, the waxing effect of the EVA could not be obtained and the tear properties of the sheath layer were insufficient.

In Comparative Example 7, an acid-modified polyolefin having a glass transition point higher than −55° C. was used as the acid-modified polyolefin resin (a2). Thus, the cold resistance of the insulation coating layer was low. Since the content of the non-halogen flame retardant was as low as 140 parts by mass in the sheath layer, the flame retardancy was low.

In Comparative Example 8, the VA content in the base polymer (A) was 25% by mass or more and 50% by mass or less but an EVA having a melting point of 70° C. or higher was not added. Accordingly, the room-temperature storage property and the fuel resistance were low. The sheath contained an excessively large amount, i.e., 230 parts by mass, of a non-halogen flame retardant and thus the initial elongation was low.

Exemplary Modes of the Present Invention

Exemplary embodiments of the present invention are noted below.

[Note 1] A exemplary embodiment of the present invention provides a cable that includes:

a conductor;

an insulation coating layer disposed on an outer periphery of the conductor; and an outer coating layer disposed on an outer periphery of the insulation coating layer, wherein the insulation coating layer is made of a non-halogen flame-retardant resin composition that contains 100 parts by mass of a base polymer (A) and 100 parts by mass or more and 250 parts by mass or less of a non-halogen flame retardant, the base polymer (A) containing 70% by mass or more and 99% by mass or less of an ethylene-vinyl acetate copolymer (a1) that contains an ethylene-vinyl acetate copolymer having a melting point of 70° C. or higher, and 1% by mass or more and 30% by mass or less of an acid-modified polyolefin resin (a2) having a glass transition point of −55° C. or lower; and the base polymer (A) contains 25% by mass or more and 50% by mass or less of a vinyl acetate component derived from the ethylene-vinyl acetate copolymer (a1), and wherein the outer coating layer is made of a non-halogen flame-retardant resin composition that contains 100 parts by mass of a base polymer (B) and 150 parts by mass or more and 220 parts by mass or less of a non-halogen flame retardant, the base polymer (B) containing 60% by mass or more and 70% by mass or less of a linear low-density polyethylene (b1), 10% by mass or more of an ethylene-vinyl acetate copolymer (b2) having a melt flow rate of 100 g/10 min or more, and 10% by mass or more and 20% by mass or less of a maleic acid-modified polyolefin (b3).

[Note 2] The cable of Note 1 above, wherein the ethylene-vinyl acetate copolymer having a melting point of 70° C. or higher preferably has a melt flow rate of 6 g/10 min or more.

[Note 3] The cable of Note 1 or 2 above, wherein at least one of the non-halogen flame retardants is exemplary a metal hydroxide.

[Note 4] The cable of Note 1, 2, or 3 above, wherein at least one of the non-halogen flame retardants is exemplary a non-halogen flame retardant treated with silane or a fatty acid.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

What is claimed is:

1. A cable, comprising:

a conductor;

an insulation coating layer disposed on an outer periphery of the conductor; and an outer coating layer disposed on an outer periphery of the insulation coating layer, wherein the insulation coating layer is consisted of a non-halogen flame-retardant resin composition that contains 100 parts by mass of a base polymer (A) and 100 parts by mass or more and 250 parts by mass or less of a non-halogen flame retardant, the base polymer (A) consisting of 70% by mass or more and 99% by mass or less of an ethylene-vinyl acetate copolymer (a1) that contains an ethylene-vinyl acetate copolymer having a melting point of 70° C. or higher, and 1% by mass or more and 30% by mass or less of an acid-modified polyolefin resin (a2) having a glass transition point of −55° C. or lower, and the base polymer (A) contains 25% by mass or more and 50% by mass or less of a vinyl acetate component derived from the ethylene-vinyl acetate copolymer (a1), wherein the outer coating layer comprises a non-halogen flame-retardant resin composition that contains 100 parts by mass of a base polymer (B) and 150 parts by mass or more and 220 parts by mass or less of a non-halogen flame retardant, the base polymer (B) containing 60% by mass or more and 70% by mass or less of a linear low-density polyethylene (b1), 10% by mass or more of an ethylene-vinyl acetate copolymer (b2) having a melt flow rate of 100 g/10 min or more, and 10% by mass or more and 20% by mass or less of a maleic acid-modified polyolefin (b3), wherein a VA content of the ethylene-vinyl acetate copolymer (a1) is 6% by mass or more and 24% by mass or less, wherein at least one of the non-halogen flame retardants comprises a metal hydroxide, and wherein the metal hydroxide comprises one of:

magnesium hydroxide comprising a silane-treated magnesium hydroxide and a fatty acid-treated magnesium hydroxide; and aluminum hydroxide comprising a silane-treated aluminum hydroxide and a fatty acid-treated aluminum hydroxide.

2. The cable according to claim 1, wherein the ethylene-vinyl acetate copolymer having a melting point of 70° C. or higher has a melt flow rate of 6 g/10 min or more.

3. The cable according to claim 1, wherein the insulation coating layer is multilayer.

4. The cable according to claim 1, wherein the outer coating layer is multilayer.

5. The cable according to claim 1, wherein the base polymer (B) comprises a polymer other than the linear low-density polyethylene (b1), the ethylene-vinyl acetate copolymer (b2), and the maleic acid-modified polyolefin (b3).

6. The cable according to claim 1, wherein the maleic acid-modified polyolefin comprises one of a natural rubber, a butyl rubber, an ethylene propylene rubber, an ethylene a-olefin copolymer, a styrene butadiene rubber, a nitrite rubber, an acrylic rubber, a silicone rubber, an urethane rubber, polyethylene, polypropylene, an ethylene-vinyl acetate copolymer, polyvinyl acetate, an ethylene-ethyl acrylate copolymer, an ethylene acrylate copolymer, and polyurethane.

7. The cable according to claim 1, wherein the maleic acid-modified polyolefin comprises a polymer obtained by grafting maleic anhydride to a polyolefin or a copolymer of a polyolefin and maleic anhydride.

8. The cable according to claim 1, wherein the outer coating layer is an outermost layer.

9. The cable according to claim 1, wherein a polyolefin material of the acid-modified polyolefin resin comprises one of ultra-low-density polyethylene, ethylene-methyl acrylate copolymers, ethylene-ethyl acrylate copolymers, ethylene-butene-1 copolymers, ethylene-hexene-1 copolymers, and ethylene-octene-1 copolymers.

10. The cable according to claim 1, wherein the acid of the acid-modified polyolefin resin comprises one of maleic acid, maleic anhydride, and fumaric acid.

11. The cable according to claim 1, wherein the acid-modified polyolefin resin comprises a polyolefin modified by an unsaturated carboxylic acid or a derivative thereof.

12. The cable according to claim 1, wherein the insulation coating layer is crosslinked.

13. The cable according to claim 1, wherein the outer coating layer is crosslinked.

14. The cable according to claim 1, wherein the metal hydroxide comprises the magnesium hydroxide comprising the silane-treated magnesium hydroxide and the fatty acid-treated magnesium hydroxide.

15. The cable according to claim 1, wherein the metal hydroxide comprises the aluminum hydroxide comprising the silane-treated aluminum hydroxide and the fatty acid-treated aluminum hydroxide.

* * * * *